United States Patent [19]

Collins

[11] 4,379,824

[45] Apr. 12, 1983

[54] DEVELOPER COMPOSITIONS HAVING LAYER OF A PIGMENT ON THE SURFACE THEREOF

[75] Inventor: Stanley B. Collins, White Bear Lake, Minn.

[73] Assignee: Minnesota Mining and Manufacturing Company, St. Paul, Minn.

[21] Appl. No.: 255,294

[22] Filed: Apr. 17, 1981

[51] Int. Cl.[3] ..... G03G 9/14; G03G 13/09

[52] U.S. Cl. ..... 430/106.6; 430/108; 430/111

[58] Field of Search ..... 430/106.6, 111, 107, 430/108

[56] References Cited

U.S. PATENT DOCUMENTS

| | | | |
|---|---|---|---|
| 3,900,412 | 8/1975 | Kosel | 430/111 |
| 4,142,981 | 3/1979 | Bean et al. | 430/111 |
| 4,254,203 | 3/1981 | Oka et al. | 430/106.6 |
| 4,262,077 | 4/1981 | Ito | 430/106.6 |

*Primary Examiner*—John E. Kittle
*Assistant Examiner*—John L. Goodrow
*Attorney, Agent, or Firm*—Cruzan Alexander; Donald M. Sell; James V. Lilly

[57] ABSTRACT

A developer composition capable of developing electrostatic images on dielectric surfaces is disclosed. The composition has an electrical conductivity of at least $10^{-6}$ohm$^{-1}$centimeter$^{-1}$ and utilizes a small dimension powdered material as a coating on the essentially smooth surface of individual spheroids of a toner. The composition reduces background coloration on finished copies and eliminates the need to bias the magnetic development roll.

16 Claims, No Drawings

DEVELOPER COMPOSITIONS HAVING LAYER OF A PIGMENT ON THE SURFACE THEREOF

FIELD OF THE INVENTION

This invention relates to developer compositions useful in electrostatic printing processes, particularly those wherein the compositions are attracted to electrostatic image areas on dielectric surfaces.

BACKGROUND ART

Techniques for forming electrostatic image areas on dielectric surfaces are known. See, for example, U.S. Pat. No. 3,441,437. In these processes, electrodes (either fixed or movable) are utilized to deposit an electrostatic charge on a dielectric surface in a desired image pattern. The image pattern is then contacted with a developer composition brought into proximity to the image pattern by a magnetic development roll. The resulting developed image areas are subsequently subjected to heat, pressure, or heat and pressure to provide an essentially permanent image on the substrate.

During image formation an undesirable surface potential is applied to the dielectric surface in background (non-image) areas. Typically this surface potential is sufficient to attract enough of the developer composition to the background aras during the development step to give them undesirable coloration.

This background coloration may be reduced by applying a bias potential to the surface of the development roll which is equal to the surface potential of the background areas on the dielectric surface. However, it is very difficult to apply the appropriate bias potential to the development roll because the surface potential of the background areas varies on a given dielectric surface. Additionally, applying a bias potential adds to the complexity, size, and power requirements of electrostatic printing devices.

While many developer compositions are known, none has been found to provide the unique capabilities of the compositions of the invention. Thus, the present invention provides a composition which provides dramatically reduced background coloration when used in electrostatic printing processes that employ dielectric surfaces. Furthermore, the composition of the invention eliminates the need for applying a bias potential to the surface of the development roll.

SUMMARY OF THE INVENTION

In accordance with the present invention there is provided a dry composition capable of being attracted to electrostatic image areas on a dielectric surface, said composition having an electrical conductivity of at least $10^{-6}$ ohm$^{-1}$ centimeter$^{-1}$ (cm$^{-1}$) (preferably in the range of $10^{-5}$ to $10^{-2}$ ohm$^{-1}$cm$^{-1}$) wherein said composition comprises a plurality of discrete spheroids each having an essentially smooth surface and each comprising a thermoplastic organic resin with a magnetically responsive material distributed therein, and, from about 1 to 12 (preferably from about 1.5 to 3.5, most preferably about 2.5) $\mu$g per square centimeter of surface area of said spheroids of a coating of a first pigment on said surface. The pigment comprises individual particles each having an arithmetic mean particle size of at least 0.02 (preferably about 0.05) micron, a dibutyl phthalate absorption value (DBP) of at least 150 (preferably about 180) cubic centimeters (cm$^3$) per 100 grams (g) of said pigment, and a static electrical conductivity of at least $10^{-8}$ (preferably at least $10^{-4}$) ohm$^{-1}$ cm$^{-1}$.

Also provided herein is a dry composition capable of being attracted to electrostatic image areas on a dielectric surface, said composition having an electrical conductivity of at least $10^{-6}$ ohm$^{-1}$cm$^{-1}$ (preferably one in the range of $10^{-5}$ to $10^{-2}$ ohm$^{-1}$cm$^{-1}$); wherein said composition comprises a plurality of discrete spheroids each having an essentially smooth surface and each comprising a thermoplastic organic resin with a first magnetically responsive material and a magnetically non-responsive pigment having an electrical conductivity of at least $10^{-8}$ ohm$^{-1}$cm$^{-1}$ distributed therein, and from about 15 to 70 $\mu$g (preferably from about 20 to 40 $\mu$g)per square centimeter of surface area of a said spheroids of a coating of a second magnetically responsive material having a needle-like structure, a static electrical conductivity of at least $10^{-7}$ ohm$^{-1}$cm$^{-1}$, and an arithmetic mean maximum particle size of at least 0.1 micron on said smooth surface.

As it is used herein, the term "spheroids" includes bodies that are spherical and bodies that are almost spherical.

The materials used as the coatings are not embedded into the surface of the spheroids. Rather they exist as a discrete layer that is held to the surface of the spheroids by weak forces such as Van der Waals forces. Additionally, the coating need not provide a continuous layer around the spheroids.

DETAILED DESCRIPTION

Developer compositions that are attracted to electrostatic image areas are known. For example, U.S. Pat. No. 4,082,681 describes a developer that consists essentially of a dry blend of (A) spherical particles comprising a binder resin with a magnetic material dispersed therein so that the magnetic material forms a crater-like rough surface on the spherical particles; and (B) an electrically conductive carbon black stuck to the spherical particles in the craters of the crater-like rough surfaces. It is said that the crater-like surface is necessary to sufficiently stick the carbon black to the toner to provide adequate image quality. It is also said that merely dry-blending the carbon black with a known magnetic material (e.g., a binder resin containing a magnetic material dispersed essentially uniformly therein) will not sufficiently hold the carbon black thereto. Rather, it is said that the carbon particles will separate from the magnetic material and adhere to the background to degrade the clearness of the copies.

U.S. Pat. No. 3,781,207 discloses a developer comprised of electrically conductive carrier particles and electrostatically attractable, non-conductive toner particles. Finely divided particles, such as carbon particles, are mixed with the carrier particles and electrostatically attractable toner particles. It is said that materials, such as $SiO_2$, may be employed in place of carbon black as the finely divided particles.

The dry developer composition of the present invention is an electrically conductive one-part composition comprising essentially smooth-surfaced spheroids having a coating of a defined powdered material theron. The composition preferably has a weight average particle size in a range such that at least about 95 weight % of the developer has a maximum dimension greater than about 12 microns but only 5 weight % has a maximum dimension greater than 80 microns. Most preferably the developer size is such that at least about 95 weight % of the particles have a maximum dimension greater than about 16 microns but only 5 weight % has a maximum dimension greater than about 50 microns.

The reduction in background coloration achieved by use of the present invention is the result of utilizing a defined powdered material as a coating over defined spheroids. Two classes of powdered materials are useful in the invention. The first has an arithmetic mean particle size of at least 0.02 micron (preferably about 0.03 micron), a dibutyl phthalate absorption value of at least 150 $cm^3$ per 100 g of the powdered material (preferably about 180 $cm^3$ per 100 g of the powdered material), and a static electrical conductivity of at least $10^{-8}$ $ohm^{-1}cm^{-1}$ (preferably $10^{-4}$ to $10^{-2}$ $ohm^{-1}cm^{-1}$).

This first class of powdered materials comprises a magnetically non-responsive pigment. Examples of useful pigments include carbon blacks such as "Vulcan" XC-72R, average particle size of 0.03 micron, DBP of 185 $cm^3$/100 g, static electrical conductivity of about $10^{-2}$ $ohm^{-1}cm^{-1}$ sold by Cabot Corporation; and Conductex 950, average particle size of 0.02 micron, DBP of 175 $cm^3$/100 g, static electrical conductivity of about $10^{-2}$ $ohm^{-1}cm^{-1}$ sold by Citco.

The second class of materials useful as the powdered material comprises a magnetically responsive material having a needle-like crystalline structure and an arithmetic mean maximum particle size of at least 0.2 micron, preferably about 0.4 micron. A useful magnetic material for this purpose is acicular magnetite, such as MO4232 available from Pfizer and having a maximum dimension of about 0.4 micron.

The powdered material is incorporated into the developer composition by simply combining either a commercially available spheroidal toner powder or a specifically prepared spheroidal composition with the powdered material and blending the two for from about 0.5 to 3½ hours at ambient temperature, preferably about 15° C. to 30° C.

The amount of the powdered material employed in the coating must be sufficient to provide the above-mentioned surface concentrations on the spheroids. It has been found that when the surface concentration of the powdered material is outside of the above-mentioned limits, the resulting developer does not provide acceptable prints. For example, if the surface concentration is less than the minimum set forth, the developer results in prints having a speckled appearance in background areas. It has been found by microscopic examination that these speckled areas are developer powder particles which have been attracted to the background areas by the undesirable surface potential on the dielectric surface. Developer compositions which do not have the minimum acceptable surface of concentration of powdered material produce such a speckled appearance because they do not have a sufficient level of the powdered material to dissipate the undesirable surface potential.

When, on the other hand, the surface concentration is above the maximum set forth, the developer results in prints having hazy or cloudly background areas. It has been found that this hazy or cloudy appearance is the result of excessive amounts of the powdered material coating the background areas of the dielectric surface. This haze is independent of surface potential on the dielectric surface and can be found even though a non-zero surface potential cannot be measured.

The particle size of the powdered material utilized in the invention must exceed the minimum particle size set forth and preferably does not exceed about one micron. If the particle size of the powdered materials does not exceed the minimum, then no amount of the powdered material will provide a satisfactory product. Thus, if an amount of such powdered material sufficient to eliminate speckling is utilized, then hazy background areas result. If, on the other hand, an amount of such powdered material sufficient to eliminate the hazy background is utilized, then speckling results.

As noted, the developer composition of the invention, together with certain of the ingredients used therein, must have defined minimum static electrical conductivities. These conductivities are necessary in order to provide a composition useful in dielectric printing processes and to assist in dissipating the undesirable surface potential in the background areas on the dielectric surface.

Additionally, the first class of powdered materials, i.e., the pigments, must exhibit a DBP value of at least 150 $cm^3$/100 g of pigment. The DBP value is an indication or measure of the structure of this class of materials. As it is used herein, "structure" means the aggregation of pigment particles resulting from the fusion and interlinking of separate pigment particles. Pigments having a high structure have a DBP value of greater than 110 $cm^3$/100 g of pigment. Thus, the pigments useful in the present invention can be said to be very highly structured.

It has been found that if the DBP value is less than about 150 $cm^3$/100 g of pigment, no level of pigment can be found that produces an acceptable developer composition. This so even if all other physical characteristics of the pigment meet the requirements necessary for the invention.

DBP values can be determined according to ASTM D 2414-75.

The composition of the invention may be readily prepared. For example, the spheroids may comprise either commercially available smooth-surfaced toner or an especially prepared material. In either event, the spheroids each comprise a thermoplastic organic resin having a magnetically responsive material, and optionally, a magnetically non-responsive pigment, distributed therein. The magnetically non-responsive pigment must be present when the second class of powdered materials is utilized.

Representative examples of useful thermoplastic organic resins include natural and synthetic resins, blends of natural resins, blends of synthetic resins, and blends of natural and synthetic resins. Useful natural resins include balsam, rosin, shellac, copal, etc. Useful synthetic resins include polyamides such as nylon resins and polymeric fatty acid modified polyamides; olefin resins such as polystyrenes, polyethylenes, polypropylenes, ethylene copolymers, styrene copolymers, etc.; epoxy resins; acrylic resins such as polyacrylic acid esters, acrylic acid esters, acrylic acid copolymers, and methacrylic acid copolymers; vinyl resins such as vinyl chloride resins, vinylidene resins, vinyl acetate resins, and vinyl acetal resins; polyester resins such as polyethylene terephthalate/isophthalate and polytetramethylene terephthalate/isophthalate; alkyd resins such as phthalic acid resins, and maleic acid resins; phenol formaldehyde resins; ketone resins; coumarone-indene resins; amino resins such as urea-formaldehyde resins, and melamine-formaldehyde resins; cellulose esters; and cellulose ethers.

The magnetically responsive material incorporated into the discrete particles preferably has an average particle size of at most about one micron and most preferably about 0.5 micron. Examples of useful magnetically responsive materials include triiron tetroxide ($Fe_3O_4$), diiron trioxide ($\gamma$-$Fe_2O_3$), zinc iron oxide ($ZnFe_2O_4$), ytterbium iron oxide ($Y_3Fe_3O_{12}$), cadmium iron oxide ($CdFe_2O_4$), copper iron oxide ($CuFe_2O_4$), lead iron oxide ($PbFe_{12}O_{19}$), nickel iron oxide ($NiFe_2O_4$), neodymium iron oxide ($NdFe_2O_4$), barium iron oxide ($BaFe_{12}O_{19}$), lanthanum iron oxide ($LaFeO_3$), iron powder (Fe), cobalt powder (Co), nickel powder (Ni) and the like. Triiron tetroxide is also known as magnetite.

Materials which may be used in the spheroids as the magnetically non-responsive pigment have a static electrical conductivity of at least $10^{-4}$ $ohm^{-1}cm^{-1}$ and may include the same materials described above as useful for the first class of powdered materials, provided that said materials have the requisite static electrical conductivity.

Preferably the magnetically non-responsive pigment comprises from about 0.5 to 1.5 (most preferably about 1) % by weight of the developer composition. The magnetically non-responsive pigment is preferably embedded in the spheroids as a layer near the surface of said spheroids. As it is used here, the phrase "near the surface" means that the layer is quite close to the surface of the individual spheroids and is preferably not thicker than 1/10 the radius of the spheroids. Additionally, although essentially all of the pigment is embedded, an occasional pigment particle may protrude from the surface of the spheroids. Techniques for incorporating this pigment as a layer near the surface of the spheroids are described in U.S. Pat. No. 3,639,245.

Other ingredients, such a surfactants, may be added to the developer compositions of the invention. Typically, surfactants are added to the compositions during preparation of the spheroids. When employed the surfactants typically comprise from about 0.05 to 0.15% by weight of the developer composition.

The present invention is further illustrated by means of the following examples wherein the term "percent" refers to percent by weight unless otherwise indicated. In the examples, varous properties of the developer compositions and their component parts were determined by the following techniques.

Electrical conductivity was determined according to the following technique. A sample of the material to be tested was placed in a test cell between two brass electrodes of circular cross section, each with a cross-sectional area of about 0.073 $cm^2$. An insulating cylindrical sleeve of polytetrafluoroethylene surrounded the developer and electrodes such that the developer was constrained to the shape of a small pill box. At least one of the electrodes was free to move like a piston in the insulating sleeve to provide a predetermined compression on the sample. The compression was obtained by placing a 100 g weight on the movable electrode, to give a pressure of 1,370 $g/cm^2$ on the sample. Enough of the material to be tested was placed into the cell such that the final electrode spacing under the above pressure was about 0.05 cm to about 0.1 cm, and preferably as close to 0.05 cm as possible. A voltage was applied in a series circuit arrangement consisting of the sample, an electrical current meter (such as a Keithley Model 601 electrometer), and voltage source. The static electrical conductivity of the sample was calculated from the voltage which appeared across the sample electrode and the current which flowed through it in the usual manner.

The number of particles in the background areas of the prints prepared was measured using a Porton Reticle at 70× magnification. The reticle was used to block off a given area for counting. Twenty separate areas having a total area of 6.2 $mm^2$ were examined, and the average number of particles per $mm^2$ was reported. Only particles of 5 microns or larger were counted, as smaller particles were not particles of developer composition.

The surface area of the spheroids was determined from a Coulter count of the sample using a Model TA-II Coulter Counter available from Coulter Electronics, Incorporated.

Printed Sheet Brightness (PSB) was determined by using a Photovolt, Model 670 from Triplett Electrical Engineering Company using a blue filter. The sheet to be tested was placed on an 85.5% reflectance test plate and PSB values measured at a point 7.5 centimeters from the top of the sheet. The minimum acceptable PSB for background areas is about 73% reflectance. Preferably the reflectance is at least 75%.

EXAMPLES 1-5

Electrostatically attractable developer compositions were prepared by melting a thermoplastic resin (Polywax® 1000, a 1000 molecular weight linear polyethylene from Bareco, Incorporated), adding, with agitation, a surfactant ("Emcol" CC-42, a quaternary amine surfactant from Witco Chemical Company), adding a magnetically responsive material (Magnetite K-378, an equant magnetite, average particle size of about 0.5 micron from Northern Pigments Company, Limited) and stirring for from two to three hours or until a uniform mixture of the ingredients was obtained.

The resulting molten mixture was then atomized into a cooling chamber to solidify the individual smooth-surfaced spheroids. The spheroids were then collected with a cycloe collector and classified so that 95 weight percent had a particle size greater than about 16 microns but only 5 weight percent had a particle size greater than about 50 microns.

A portion of the classified spheroids was added to a 2-quart Patterson-Kelly twin shell blender together with a magnetically non-responsive pigment ("Vulcan" XC-72R, average particle size 0.03 micron, DBP of 185 $cm^3/100$ g, static electrical conductivity of about $10^{-2}$ $ohm^{-1}cm^{-1}$, from Cabot Corporation) and blended for about one hour at room temperature. The pigment was then embedded into the spheroids as a layer near the surface of the spheroids according to the techniques described in U.S. Pat. No. 3,639,245.

A coating of a pigment ("Vulcan" XC-72R) was then provided on the surface of the spheroids by adding the spheroids and the pigment to the Patterson-Kelly blender and tumbling the mixture for about one-half to one and one-half hours at room temperature.

The resulting developer compositions were then tested for static electrical conductivity and then utilized in a Tektronix Model 4611 Hard Copy Unit available from Tektronix Incorporated to produce prints on dielectric paper. The prints were tested for number of particles per square millimeter in the background areas and PSB.

The exact formulations employed and the test results obtained are set forth in Table 1. All amounts are weight %.

TABLE 1

| | EXAMPLES | | | | |
|---|---|---|---|---|---|
| | 1 | 2 | 3 | 4 | 5 |
| Thermoplastic Resin | | | | | |
| Polywax ® 1000 | 33.4 | 33.4 | 33.4 | 33.4 | 33.4 |
| Surfactant | | | | | |
| "Emcol" cc-42 | 0.1 | 0.1 | 0.1 | 0.1 | 0.1 |
| Magnetically Responsive Material | | | | | |
| Magnetite K-378 | 65.1 | 65.1 | 65.1 | 65.1 | 65.1 |
| Magnetically Non-Responsive Pigment | | | | | |
| Vulcan XC-72R | 1.4 | 1.4 | 1.4 | 1.4 | 1.4 |
| Surface Coating Concentration | | | | | |
| ($\mu g/cm^2$ surface area) | — | 0.6 | 1.5 | 2.5 | 12 |
| Electrical Conductivity | | | | | |
| ($ohm^{-1}cm^{-1} \times 10^4$) | 10 | 3 | 5 | 9 | 10 |
| PSB | 79 | 79 | 77.5 | 75.5 | 72.6 |
| Particles/$mm^2$ | 50 | 37 | 9 | 3 | 5.8 |

The prints produced using the developer of Example 1 were unacceptable as they had a highly speckled background. The print produced using the developer of Example 2 had a slightly improved background but one that still was relatively highly speckled and was therefore, also unacceptable. The prints produced from the developers of Examples 3 and 4 were acceptable. They had only 9 and 6 particles per square millimeter. These levels are consistent with only very slight background speckling. The print produced from the developer of Example 5 was acceptable. However, it had a slight gray appearance in the background areas as is shown by its low PSB value.

EXAMPLES 6–12

Developer compositions were prepared. Spheroids were prepared as described in Examples 1–5. The spheroids were added to a 3 cubic foot Patterson-Kelly twin shell blender together with 1.4% by weight of the spheroids of a pigment (Vulcan ® XC-72R). The spheroids and pigment were tumbled together and samples were taken after various lengths of tumbling. These samples were tested for static electrical conductivity and used in the Tektronix Model 4611 Hard Copy Unit as described in Examples 1–5. The resulting prints were tested for particles/$mm^2$ and PSB. The results obtained are set forth in Table 2.

TABLE 2

| Example | Blend Time (Hrs.) | No. Particles in Background (Part./$mm^2$) | PSB | Static Electrical Conductivity ($ohm^{-1}cm^{-1} \times 10^4$) |
|---|---|---|---|---|
| 6 | 0.5 | 3.2 | 73.2 | |
| 7 | 1 | 3.5 | 74.3 | |
| 8 | 1.5 | 3.2 | 75.2 | 5 |
| 9 | 2 | 2.9 | 76.0 | |
| 10 | 2.5 | 4.4 | 76.5 | |
| 11 | 3 | 6.1 | 76.7 | |
| 12 | 3.5 | 7.6 | 76.8 | 5 |

These Examples demonstrate an alternative technique for applying the surface coating of the pigment to the spheroids. In these Examples, no magnetically non-responsive pigment was incorporated into the spheroids prior to application of the surface coating.

The resulting developer compositions each had a surface concentration of between about 1 and 12 $\mu g$ per $cm^2$ of surface area and produced acceptable prints. It is noted that the developer of Example 6 had very few speckles but did exhibit a slight gray appearance in the background areas. Even so, the prints prepared from this developer were acceptable.

EXAMPLE 13

Example 4 was repeated except that "Conductex" 950 (average particle size 0.02 micron, DBP of 175 $cm^3/100$ g, static electrical conductivity of $10^{-2}$ $ohm^{-1}cm^{-1}$, from Citco) was substituted for the "Vulcan" XC-72R as both the magnetically non-responsive pigment and the surface coating. The developer composition was tested for static electrical conductivity and then used to make prints on a Tektronix Model 4611 Hard Copy Unit as described in Examples 1–5. The resultant print had acceptable background properties. The exact formulation employed and the test results obtained are set forth in Table 3. All amounts are weight %.

TABLE 3

| | |
|---|---|
| Thermoplastic Resin | |
| Polywax ® 1000 | 33.4 |
| Surfactant | |
| "Emcol CC-42 | 0.1 |
| Magnetically Responsive Pigment | |
| Magnetite K-378 | 65.1 |
| Magnetically Non-Responsive Pigment | |
| "Conductex" 950 | 1.4 |
| Surface Coating Concentration | |
| ($\mu g/cm^2$ surface area) | 2.5 |
| Static Electrical Conductivity ($ohm^{-1}cm^{-1} \times 10^4$) | 0.5 |
| PSB | 79 |
| Particles/$mm^2$ | 9 |

EXAMPLES 14–17

Examples 1–5 were repeated except that acicular magnetite (MO4232 arithmetic mean maximum dimension of 0.5 micron from Pfizer) was substituted for the "Vulcan" XC-72R as the surface coating. The developer composition was tested for static electrical conductivity and then used to make prints on a Tektronix Model 4611 Hard Copy Unit as described in Examples 1–5. The exact formulations employed and the test results obtained are set forth in Table 4. All amounts are weight %.

TABLE 4

| | EXAMPLES | | | |
|---|---|---|---|---|
| | 14 | 15 | 16 | 17 |
| Thermoplastic Resin | | | | |
| Polywax ® 1000 | 33.4 | 33.4 | 33.4 | 33.4 |
| Surfactant | | | | |
| "Emcol" CC-42 | 0.1 | 0.1 | 0.1 | 0.1 |
| Magnetically Responsive Material | | | | |
| Magnetite D-378 | 65.1 | 65.1 | 65.1 | 65.1 |
| Magnetically Non-Responsive Pigment | | | | |
| Vulcan XC-72R | 1.4 | 1.4 | 1.4 | 1.4 |
| Surface Coating Concentration | | | | |
| ($\mu g/cm^2$ surface area) | 15 | 25 | 35 | 70 |
| Static Electrical Conductivity | | | | |
| ($ohm^{-1}cm^{-1} \times 10^4$) | 1 | 1 | 1 | 2 |
| PSB | 78 | 77 | 77 | 74 |
| Particles/$mm^2$ | 21 | 14 | 13 | 5 |

All of these developer compositions produced prints that were acceptable. The developer of Example 14 produced a print that was slightly speckled in the background areas. The developer of Example 17 produced a print that had a slight background haze. The developer of Example 17 also was more difficult to fuse to the dielectric paper.

EXAMPLE 18

A developer composition was prepared. Spheroids were prepared according to the techniques of Examples 1-5 from the following ingredients:

| | Weight % |
|---|---|
| Thermoplastic Resin | |
| Castorwax[a] | 33.9 |
| Magnetically Responsive Material | |
| "Mapico" Black (an equant magnetite, average particle size 0.5 micron from Citco) | 66 |
| Surfactant | |
| "Emcol" CC-42 | 0.1 |

[a]A synthetic wax prepared by the essentially complete hydrogenation of castor oil. Its principal constituent is the glyceride of 12-hydroxystearic acid. It contains minor quantities of glycerides of 12-hydroxystearic acid, dihydroxystearic acid and stearic acid. It is available from N.L. Industries A surface coating of "Vulcan" XC-72R was applied to the surface of spheroids by blending 1.4% by weight of the spheroids of the "Vulcan" XC-72R in a Patterson-Kelly twin shell blender for about 2.5 hours. The resulting developer composition was tested for static electrical conductivity and used in the Tektronix Model 4611 Hard Copy Unit as described in Example 1-5. The test results are set forth in Table 5.

TABLE 5

| | |
|---|---|
| Surface Coating Concentration ($\mu g/cm^2$ surface area) | 12 |
| Static Electrical Conductivity ($ohm^{-1}cm^{-1} \times 10^4$) | 10 |
| PSB | 75 |
| Particles/$mm^2$ | 6 |

EXAMPLES 19-21

Developer compositions were prepared. Spheroids were prepared by melting a thermoplastic organic resin and then stirring in a magnetically responsive material ("Mapico" Black magnetite) until a homogeneous mixture was provided. The mixture was allowed to cool, and then ground to form irregularly shaped particles. The particles were then formed into "spheroids" by first aspirating them into a moving air stream, thus creating an aerosol, and directing the aerosol at an angle of about 90°±5° through another stream of air which had been heated to between about 450° C. to 600° C., and then directing the aerosol into a cooling chamber where the now spheroidal particles were collected by a cyclone collector. After cooling, the spheroids were classified so that 95 weight % had a particle size of greater than 16 microns but only 5 weight % had a particle size greater than 50 microns when measured by volume count using a Coulter Counter.

A surface coating of "Vulcan" XC-72R was then provided on the surfaces of the spheroids by charging both the spheroids and the "Vulcan" XC-72R to a Patterson-Kelly twin shell blender, and tumbling the mixture until the desired surface concentration was achieved.

The developer compositions were tested for static electrical conductivity and then used to make prints on a Tektronix Model 4611 Hard Copy Unit as described in Examples 1-5. The formulations prepared and the results achieved are given in Table 6.

TABLE 6

| | 19 | 20 | 21 |
|---|---|---|---|
| Thermoplastic Resin | | | |
| "Atlac" 328E (Bisphenol-A-fumurate polyester resin from ICI America) | 40 | 36 | — |
| "ORG" 0018 (Styrene:n-butyl acrylate copolymer (70:30) from Hercules) | — | — | 40 |
| Castorwax | — | 4 | — |
| Magnetically Responsive Pigment | | | |
| "Mapico" Black | 60 | 60 | 60 |
| Surface Concentration ($\mu g/cm^2$ surface area) | 12 | 12 | 12 |
| Tumbling Time (hrs) | 1.5 | 0.5 | 2 |
| Static Electrical Conductivity ($ohm^{-1}cm^{-1} \times 10^4$) | 10 | 1 | 0.3 |
| PSB | 75 | 75 | 75 |
| Particles/$mm^2$ | 5 | 8 | 7 |

I claim:

1. A dry composition capable of being attracted to electrostatic image areas on a dielectric surface, said composition having a static electrical conductivity of at least $10^{-6}$ $ohm^{-1}centimeter^{-1}$ wherein said composition comprises a plurality of discrete spheroids each having an essentially smooth surface and each comprising a thermoplastic organic resin with a magnetically responsive material distributed therein, and from about 1 to 12 $\mu g$ per square centimeter of surface area of said spheroids of a coating of a first pigment on said smooth surface wherein said first pigment comprises particles each having an arithmetic mean particle size of at least 0.02 micron, a dibutyl phthalate absorption value of at least 150 cubic centimeters per 100 grams of said pigment, and a static electrical conductivity of at least $10^{-8}$ $ohm^{-1}centimeter^{-1}$.

2. A composition according to claim 1 comprising from about 1.5 to 3.5 $\mu g$ per square centimeter of surface area of said spheroids.

3. A composition according to claim 1 wherein said first pigment comprises carbon black.

4. A composition according to claims 1, 2 or 3 wherein said first pigment has an arithmetic mean particle size of at least 0.03 micron, a dibutyl phthalate absorption value of at least 180 cubic centimeters per 100 grams of said pigment, and a static electrical conductivity of at least $10^{-4}$ $ohm^{-1}centimeter^{-1}$.

5. A composition according to claim 3 wherein said spheroids each further include a magnetically nonresponsive second pigment having a static electrical conductivity of at least $10^{-8}$ $ohm^{-1}centimeter^{-1}$.

6. A composition according to claim 5 wherein said second pigment is embedded in said spheroids as a layer near said smooth surface.

7. A composition according to claim 6 wherein said second pigment is carbon black.

8. A composition according to claim 1 wherein said magnetically responsive material comprises magnetite.

9. A dry composition capable of being attracted to electrostatic image areas on a dielectric surface, said composition having a static electrical conductivity of at least $10^{-6}$ $ohm^{-1}centimeter^{-1}$ wherein said composition comprises a plurality of discrete spheroids each having an essentially smooth surface and each comprising a thermoplastic organic resin with a first magnetically responsive material and a magnetically nonresponsive pigment having a static electrical conductivity of at least $10^{-4}$ $ohm^{-1}centimeter^{-1}$ distributed therein, and from about 15 to 70 $\mu g$ per square centimeter of surface area of said spheroids of a coating of a second magnetically responsive material having a needle-like structure, a static electrical conductivity of at least $10^{-7}$ $ohm^{-1}cm^{-1}$, and an arithmetic mean maximum dimension of at least 0.2 micron on said smooth surface.

10. A composition according to claim 9 comprising from about 20 to 40 $\mu g$ of said coating per square centimeter of said spheroids.

11. A composition according to claim 9 wherein said first and second magnetically responsive materials individually comprise magnetite.

12. A composition according to claims 9, 10, or 11 wherein said electrically conductive, magnetically non-responsive pigment is embedded in said spheroids as a layer near said smooth surface.

13. A composition according to claim 12 wherein said electrically conductive, magnetically non-responsive pigment comprises carbon black.

14. A composition according to claim 10 wherein said second magnetically responsive material has an arithmetic mean maximum particle size of at least 0.4 micron.

15. A composition according to claim 14 wherein said second magnetically responsive material is acicular magnetite.

16. A composition according to claims 1 or 9 wherein said spheroids further include a surfactant.

* * * * *